US006883794B2

(12) United States Patent
Huang

(10) Patent No.: US 6,883,794 B2
(45) Date of Patent: Apr. 26, 2005

(54) ADJUSTABLE POSITIONING DEVICE

(75) Inventor: Ming-Yi Huang, Taichung (TW)

(73) Assignee: Benq Corporation, Taoyuan Shien (TW)

( * ) Notice: Subject to any disclaimer, the term of this patent is extended or adjusted under 35 U.S.C. 154(b) by 0 days.

(21) Appl. No.: 10/659,112

(22) Filed: Sep. 10, 2003

(65) Prior Publication Data

US 2004/0145104 A1 Jul. 29, 2004

(30) Foreign Application Priority Data

Jan. 27, 2003 (TW) ..... 92101750 A

(51) Int. Cl.[7] ..... B25B 1/04

(52) U.S. Cl. ..... 269/217; 269/233; 269/234; 269/900

(58) Field of Search ..... 269/900, 133, 269/217, 233, 234, 303, 305, 908, 909

(56) References Cited

U.S. PATENT DOCUMENTS 4,157,819 A * 6/1979 Meyer ..... 269/231

5,513,836 A * 5/1996 Hillenburg ..... 269/101

* cited by examiner

*Primary Examiner*—Joseph J. Hail, III

(74) *Attorney, Agent, or Firm*—Thomas, Kayden, Horstemeyer & Risley

(57) ABSTRACT

An adjustable positioning device used to position a work piece on a work platform is provided. The adjustable positioning device includes a base which is coupled to the work platform and has multiple sockets, and a supporting frame which has multiple slots. The supporting frame further includes a supporting portion protruded from a lateral side of the supporting frame, a number of bars which are installed at the bottom of the supporting frame and are used to insert into selected sockets, a slide block with a sliding section and a pressing section wherein the sliding section is able to slide and can be selectively fixed in a slot while the pressing section and the supporting portion are opposed to each other. The work piece can be retained between the pressing section and the supporting portion.

16 Claims, 5 Drawing Sheets

ADJUSTABLE POSITIONING DEVICE

This application claims the benefit of Taiwan application Ser. No. 92101750, filed Jan. 27, 2003.

BACKGROUND OF THE INVENTION

1. Field of the Invention

The invention relates in general to an adjustable positioning device, and more particularly to an adjustable positioning device for positioning a work piece on a moving platform.

2. Description of the Related Art

During the manufacturing process of a screen, most of the measurements and tests are performed on a moving platform which carries and transports the screen to respective measuring and testing equipment to be measured and tested. A conventional cathode ray tube screen (CRT screen), whose configuration is squared and cubic with a large base area, can be placed on a moving platform and remain steady when moving with no need to be connected to any stabilizing base or using any positioning device. Therefore, the CRT screen, which is placed on a moving platform, can stand vertically thereon. The measuring and testing equipment, if installed beside the moving platform, can easily measure and test the CRT screen which stands erect.

While a CRT screen can steadily stand erect on the moving platform, an LCD screen, considering its plate type configuration with a small base area, can only be laid on the moving platform with its screen facing upward to gain a better steadiness for the lack of a stabilizing base. In order to see the screen display clearly, the inspector standing beside the moving platform has to view from above. The measuring and testing equipment installed besides the moving platform needs to stretch out its cantilever and can only measure and test the screen from above which is indeed inconvenient and lack of efficiency in terms of automation.

SUMMARY OF THE INVENTION

It is therefore an object of the invention to provide an adjustable positioning device, allowing LCD screens of different thickness and width to be easily retained and to stand erect at a positioned location on a work platform for measurement or inspection.

According to the above object, an adjustable positioning device for positioning an LCD screen on a work platform and making the LCD screen stand erect thereon is provided. The adjustable positioning device includes a base, which is coupled to the work platform and has multiple sockets, and a supporting frame with multiple slots wherein these slots penetrate the supporting frame in a sliding-down direction. The supporting frame further includes a supporting portion protruded from a lateral side of the supporting frame, a number of bars which are installed at the bottom of the supporting frame and are used to insert into selected sockets, a slide block including a sliding section and a pressing section wherein the sliding section is able to slide and can be selectively fixed in a slot with the pressing section and the supporting portion being opposed to each other. The sliding section can slide downward by gravity of the slide block, bringing the pressing section to move towards the supporting portion. By fixing and fixing the sliding section in the slot, the pressing section together with the supporting portion hold the LCD screen tightly for the measuring and testing equipment to perform measurements and tests.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1A:
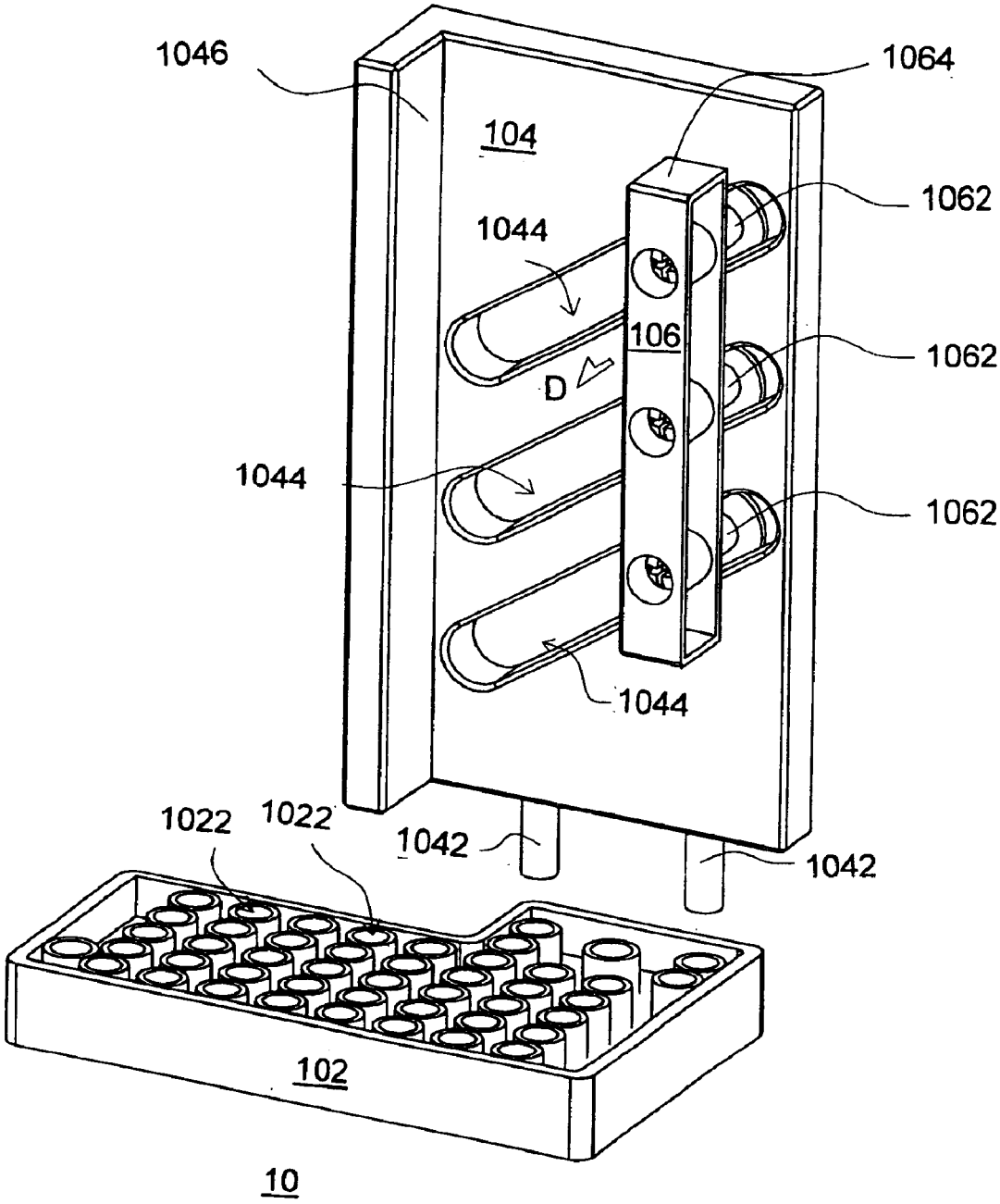
FIG. 1A is a schematic view of an adjustable positioning device according to a preferred embodiment of the invention.
Figure 1B:
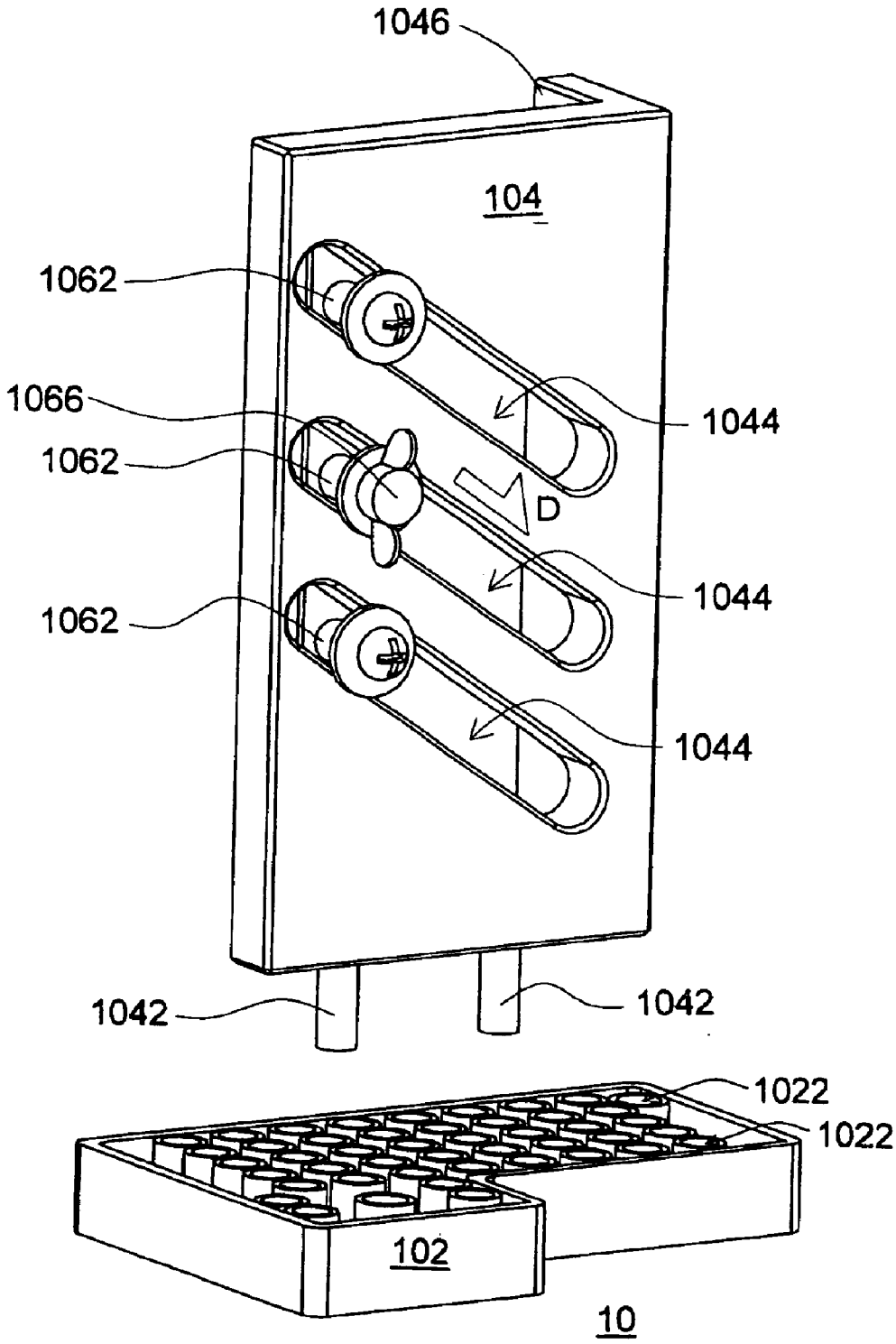
FIG. 1B is a schematic view from another angle of an adjustable positioning device according to the preferred embodiment of the invention.

Please refer to FIGS. 1A and 1B. FIG 1A shows a schematic view of an adjustable positioning device according to a preferred embodiment of the invention, while FIG. 1B shows a schematic view from another angle of an adjustable positioning device according to the preferred embodiment of the invention. The adjustable positioning device 10 is used to make a work piece such an LCD screen whose configuration is flat and whose base area is small to be retained and to stand erect at a positioned location on a work platform for the measuring and testing equipment to measure and test. For example, the measurements and tests of color display, screen brightness and homogeneity.

The adjustable positioning device 10 includes a base 102, a supporting frame 104 and a slide block 106. The base 102 has a number of sockets 1022 arrayed in matrix form wherein these sockets are identical in terms of size. The supporting frame 104 includes (a) a supporting portion 1046 protruded from one of the lateral sides, (b) a number of bars which are extended from the bottom of the body and can be inserted into these sockets 1022 perfectly, and (c) a number of slots 1044 penetrating the supporting frame in a sliding-down direction towards the supporting portion, so the end of the slot 1044 closer to the supporting portion has a lower position than the other end of the slot 1044. The slide block 106 includes (a) a sliding section 1062, (b) a fixing and fixing section such as a bolt 1066 which can slide in the slot 1044 and can selectively lock and fix the sliding section 1062 in the slot 1044, and (c) a pressing section 1064.

Figure 2A:
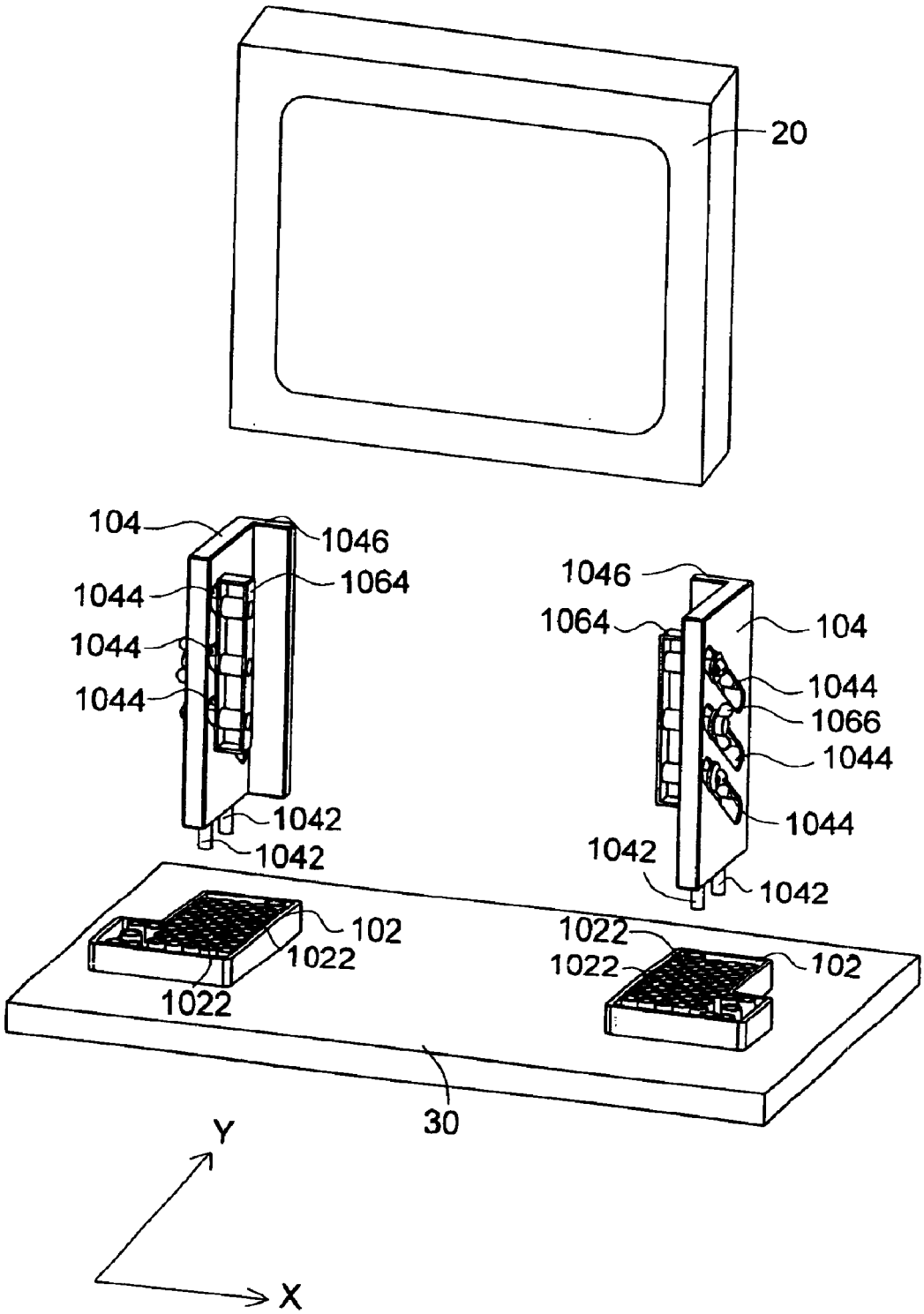
FIG. 2A is a schematic view illustrating the relative position among an LCD screen, a work platform, and an adjustable positioning device according to the preferred embodiment of the invention.
Figure 2B:
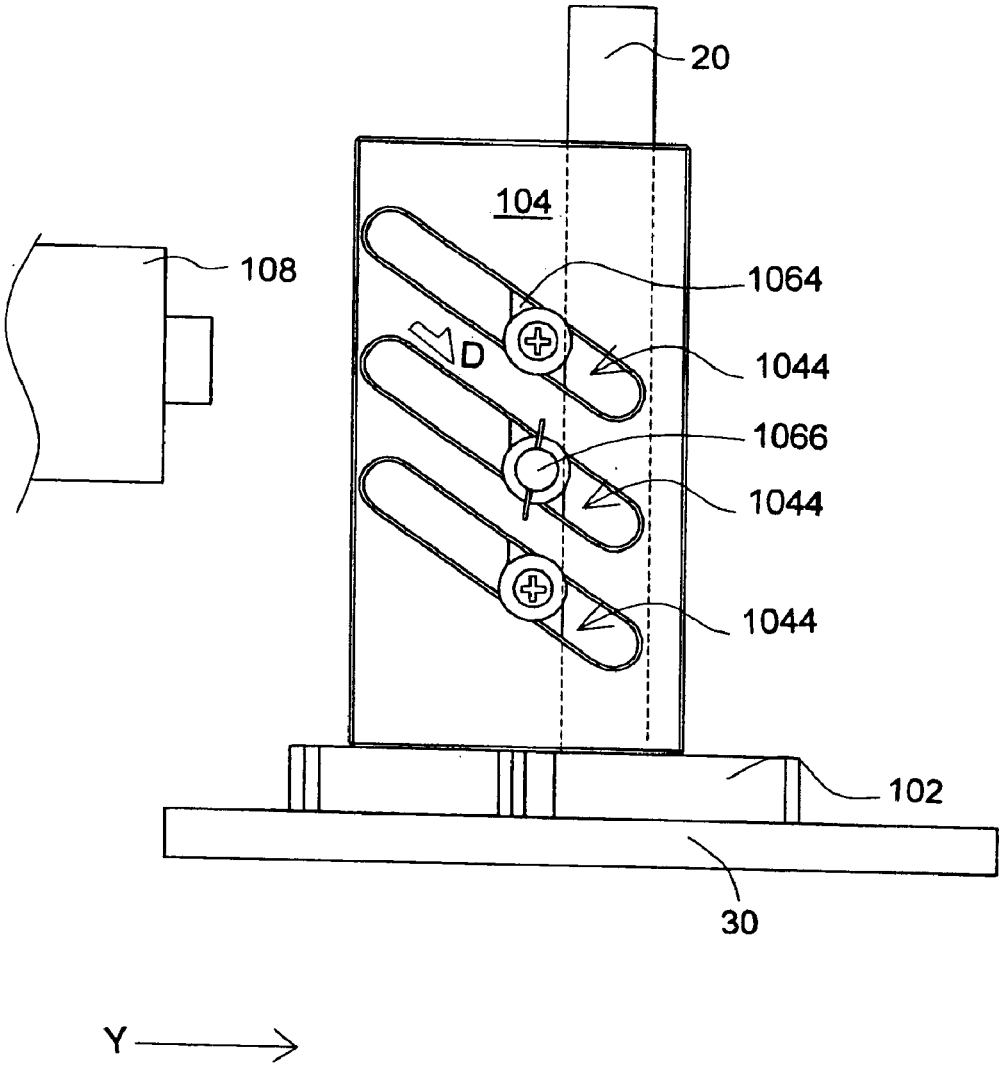
FIG. 2B is a cross-sectional view for the integration of an LCD screen, a work platform, a measuring and testing equipment, and an adjustable positioning device according to the preferred embodiment of the invention.

Please refer to FIGS. 1A, 1B, 2A and 2B together. FIG. 2A is a schematic view illustrating the relative position among an LCD screen, a work platform and an adjustable positioning device according to the preferred embodiment of the invention, while FIG. 2B is a cross-sectional view of the integration of an LCD screen, a work platform, a measuring and testing equipment, and an adjustable positioning device according to the preferred embodiment of the invention.

Two adjustable positioning devices 10 according to the invention can be combined together to form a set of adjustable positioning devices retaining the two sides of the LCD screen 20 and having the LCD screen 20 positioned on the work platform 30.

The base 102 is coupled onto the work platform 30 while the measuring and testing equipment 108 is installed in front of the work platform 30 as shown in FIG. 2B. Based on the width of the LCD screen 20 and the appropriate measuring distance between the LCD screen 20 and the measuring and testing equipment 108, the user can select suitable sockets 1022 into which the bars 1042 plug. By adjusting the relative position between the supporting frame 104 and the base 102, the supporting frame 104 will be coupled to the base 102.

The sliding section 1062 of the slide block 106 is slidably received in the slot 1044. The pressing section 1064 is opposed to the supporting portion 1046. Using the gravity force of the slide block 106, the sliding section 1062 slides downward along direction D, bringing the pressing section 1064 to move towards the supporting portion 1046 so that the pressing section 1064 is able to retain the LCD screen 20. Using the bolt 1066 to lock and fix the sliding section 1062 in the slot 1044, the pressing section 1064 and the supporting portion 1046 can retain the LCD screen 20 from its front and from its rear at a fixed interval for the measuring and testing equipment 108 to measure and test the LCD screen 20.

By means of the multiple sockets arrayed in matrix on the base 102 which is coupled to the work platform 30, the bars 1042 of the supporting frame 104 can be inserted into the socket situated at appropriately selected positions on the base 102. Example (a): by adjusting the relative position between the supporting frame 104 and the base according to the width of the LCD screen 20 and by positioning the sockets 1022 into which the bars 1022 will plug along direction X as shown in FIG. 2A, the adjustable positioning device 10 according to the invention can retain the LCD screen 20 of various sizes and specifications. Example (b): the LCD screen 20 can also be adjusted and positioned at an appropriate distance for measuring and testing. For instance, with regard to respective distance required for the measurement and test of color, brightness, and homogeneity, etc. the supporting frame 104 can be moved along direction Y shown in FIGS. 2A and 2B. After an appropriate position for the measuring and testing equipment 108 has been selected, the bars 1042 will then be inserted into the corresponding sockets 1022.

Moreover, the adjustable positioning device 10 according to the invention uses the pressing section 1064 and the supporting portion 1046 to retain the LCD screen 20 from both sides, allowing the LCD screen 20 to stand erect on the work platform 30, and facilitating the measuring and testing equipment 108 to perform various measurements and tests on the LCD screen 20.

Figure 3B:
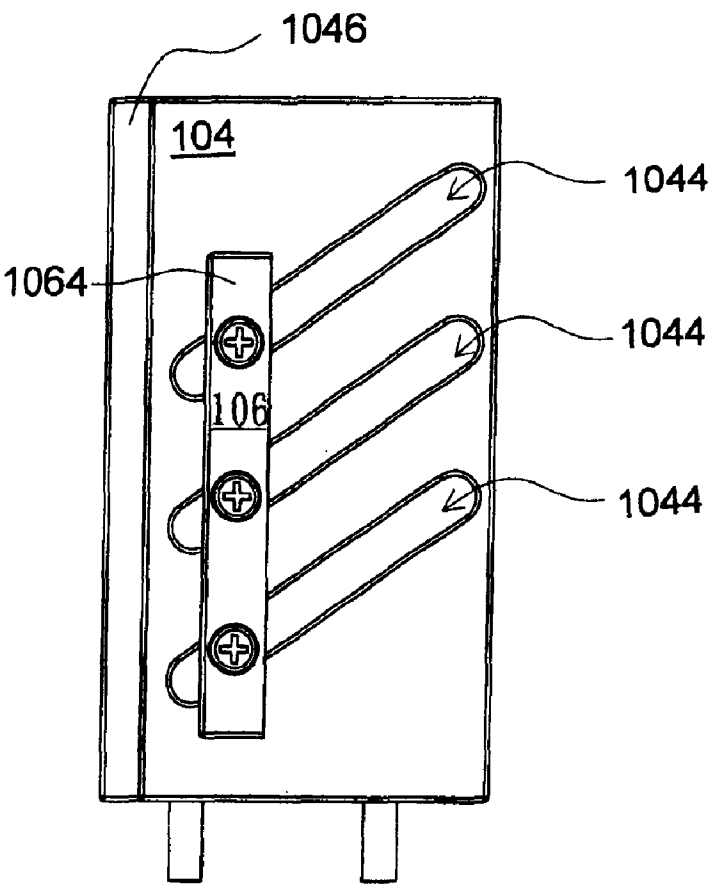
FIG. 3B is a schematic view illustrating the relative movement between the slide block and supporting frame of an adjustable positioning device according to the preferred embodiment of the invention.
Figure 3A:
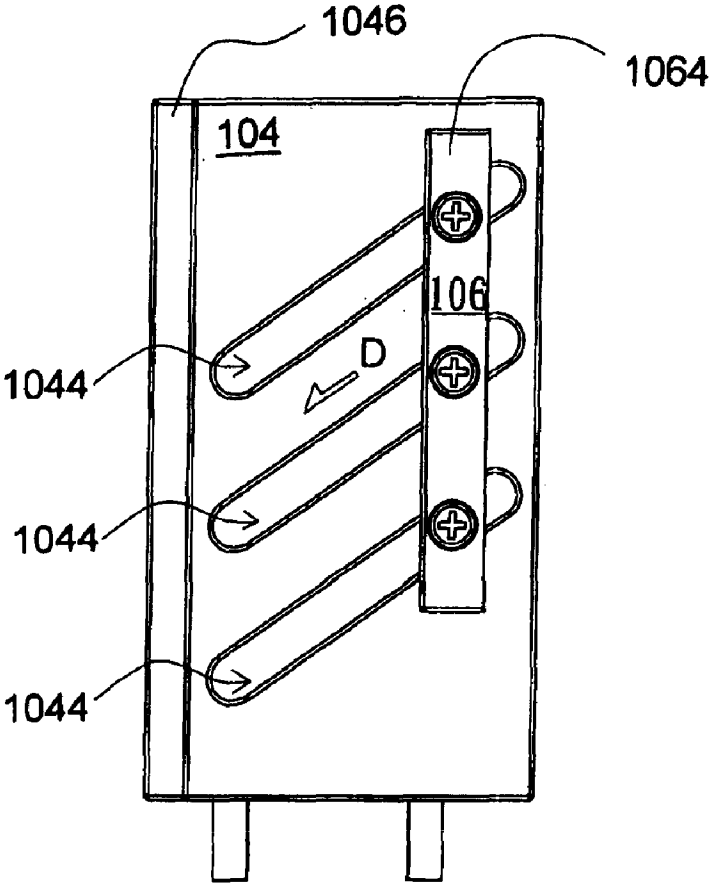
FIG. 3A is a schematic view showing the slide block and supporting frame of an adjustable positioning device according to the preferred embodiment of the invention.

Please refer to FIGS. 3A and 3B together. FIG. 3A is a schematic view showing the slide block and supporting frame of an adjustable positioning device according to a preferred embodiment of the invention while FIG. 3B is a schematic view illustrating the relative movement between the slide block and supporting frame of an adjustable positioning device according to the preferred embodiment of the invention. The slide block 106 can slide in the slot 1044 via the sliding section 1062, bringing the pressing section 1064 to move towards the supporting portion 1046.

Since the slot 1044 is a ditch sliding downward, by gravity of its own weight, the slide block 106 can slide towards the supporting portion 1046 along the sliding downward direction D shown in FIG. 3A. Therefore, the relative position between the slide block 106 and the supporting portion 1046 can be adjusted according to the thickness of the LCD screen such that the pressing section 1064 can retain the LCD screen firmly. After that, the sliding section can be fastened by using a bolt (not shown here) and the sliding section 1062 can be fixed in the slot 1044 such that the LCD screen can be retained between the pressing section 1064 and the supporting portion 1046 at a fixed interval.

Apart from the LCD screen, the adjustable positioning device or the set of adjustable positioning devices according to the invention can also be used to position other plate type work pieces. The work platform can be a moving platform carrying an LCD screen to move towards or away from a measuring and testing equipment. The base 102 is coupled to the work platform via the bolt. For instance, the base 102 can be screwed and fixed onto the work platform. Part of the slide block 106 or the sliding section 1062 can be made of metal materials, giving the slide block a larger gravity force, furthering the pressing section 1064 and the supporting portion 1046 to retain the LCD screen.

The adjustable positioning device disclosed in the above embodiment of the invention allows a plate type LCD screen to be fixed firmly prior to the installation of a base, reducing measurement errors caused by positioning problems, improving automation efficiency and facilitating the consistency in the production line. The adjustable positioning device according to the invention also allows the LCD screen with a plate type configuration to be positioned on the work platform and stand erect, facilitating the inspector to acquire the information of measurement and test from the screen display. With the design of planting multiple sockets on the base and the structure of having a slide block, the adjustable positioning device can be adjusted to retain the LCD screens of various sizes and specifications according to their various width and thickness. The adjustable positioning device can also be adjusted and positioned forward or backward according to what distance is necessary for measurements and tests, allowing the LCD screen to be positioned at an appropriate location on the work platform for measurements and tests.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An adjustable positioning device for positioning a work piece on a work platform, the adjustable positioning device comprising:

a base having a plurality of sockets, the base being disposed on the work platform;

a supporting frame, comprising:

a supporting portion protruded from a lateral side of the supporting frame;

a plurality of bars protruded from the bottom of the supporting frame, the bars inserted into the sockets for coupling the supporting frame onto the base, the relative position between the supporting frame and the base is adjustable according to a width of the work piece; and a slot penetrating the supporting frame and extending along a sliding-down direction with one end of the slot closer to the supporting portion being lower than the other end of the slot; and a slide block comprising a sliding section, a fixing mechanism, and a pressing section, wherein the sliding section is slidably received in the slot, and the fixing mechanism capable of selectively fixing the sliding section onto the supporting frame;

wherein due to the weight of the slide block, the sliding section is able to slide along the sliding-down direction, to make the pressing section moving towards the supporting portion, so that the work piece is retained by the pressing section and the supporting portion.

2. The adjustable positioning device according to claim 1, wherein the device is for positioning a liquid crystal display screen (LCD screen) which stands erect on the work platform when retained between the pressing section and the supporting portion.

3. The adjustable positioning device according to claim 1, wherein the device is for positioning the work piece on a moving platform on a conveyer.

4. The adjustable positioning device according to claim 1, wherein the base and the work platform are coupled together via bolts.

5. The adjustable positioning device according to claim 1, wherein the sockets are arrayed in matrix form on the base and are selectively inserted by the bars.

6. The adjustable positioning device according to claim 1, wherein the sliding section is made of metal materials.

7. The adjustable positioning device according to claim 1, wherein the fixing mechanism is a bolt.

8. An adjustable positioning device for positioning a work piece on a work platform, wherein the adjustable positioning device comprises:

a base having a plurality of sockets, the base being disposed on the work platform;

a supporting frame having a plurality of slots, the supporting frame comprising:

a supporting portion protruded from a lateral side of the supporting frame; and a plurality of bars formed at the bottom of the supporting frame, the bars inserted into the sockets; and a slide block comprising a sliding section and a pressing section, the sliding section slidably received and selectively fixed within the slots, the pressing section and the supporting portion are opposed to each other;

wherein the work piece is retained between the pressing section and the supporting portion.

9. The adjustable positioning device according to claim 8, wherein the base is screwed and fixed onto the work platform.

10. The adjustable positioning device according to claim 8, wherein the device is for positioning an LCD screen.

11. The adjustable positioning device according to claim 8, wherein the sockets are arrayed in matrix form on the base and are selectively inserted by the bars.

12. The adjustable positioning device according to claim 11, wherein part of the slide block is made of metal materials, the sliding section slides along the sliding-down direction by gravity of the slide block, bringing the pressing section to move towards the supporting portion, and fixing the sliding section in the slots via the fixing mechanism so that the work piece is retained between the pressing section and the supporting portion.

13. A set of adjustable positioning devices having a first positioning device and a second positioning device for positioning a work piece on a work platform by retaining the two sides of the work piece, wherein each of the positioning devices comprises:

a base having a plurality of sockets, the base being disposed on the work platform;

a supporting frame which has a plurality of slots, the supporting frame comprising:

a supporting portion protruded from a lateral side of the supporting frame; and a plurality of bars formed at the bottom of the supporting frame, and the bars inserted into the sockets; and a slide block comprising a sliding section and a pressing section, wherein the sliding section is slidably received and selectively fixed in the slots, while the pressing section and the supporting portion are opposed to each other;

wherein the two lateral sides of the work piece are retained between the pressing section and the supporting portion of the first and the second positioning devices respectively.

14. The adjustable positioning device according to claim 13, wherein the device is for positioning an LCD screen.

15. The adjustable positioning device according to claim 13, wherein the sockets are arrayed in matrix form on the base and are selectively inserted by the bars.

16. The adjustable positioning device according to claim 11, wherein part of the slide block is made of metal materials, the sliding section slides along the sliding-down direction by gravity of the slide block, bringing the pressing section to move towards the supporting portion, and fixing the sliding section in the slots via the fixing mechanism so that the work piece is retained between the pressing section and the supporting portion for the measurement and test of the measuring and testing equipment.

* * * * *